US010558154B1

(12) United States Patent
Kajiyama et al.

(10) Patent No.: US 10,558,154 B1
(45) Date of Patent: Feb. 11, 2020

(54) IMAGE FORMING APPARATUS INCORPORATING PRESSING DEVICE

(71) Applicants: Hiroshi Kajiyama, Tokyo (JP); Naoki Iwaya, Tokyo (JP); Hitoshi Fujiwara, Kanagawa (JP); Takuya Seshita, Kanagawa (JP); Takahiro Imada, Kanagawa (JP); Yoshiharu Takahashi, Tokyo (JP); Natsuki Watanabe, Kanagawa (JP)

(72) Inventors: Hiroshi Kajiyama, Tokyo (JP); Naoki Iwaya, Tokyo (JP); Hitoshi Fujiwara, Kanagawa (JP); Takuya Seshita, Kanagawa (JP); Takahiro Imada, Kanagawa (JP); Yoshiharu Takahashi, Tokyo (JP); Natsuki Watanabe, Kanagawa (JP)

(73) Assignee: RICOH COMPANY, LTD., Tokyo (JP)

( * ) Notice: Subject to any disclaimer, the term of this patent is extended or adjusted under 35 U.S.C. 154(b) by 0 days.

(21) Appl. No.: 16/521,914

(22) Filed: Jul. 25, 2019

(30) Foreign Application Priority Data

Jul. 27, 2018 (JP) ..... 2018-140954
Dec. 17, 2018 (JP) ..... 2018-235156

(51) Int. Cl.
*G03G 15/20* (2006.01)

(52) U.S. Cl.
CPC ..... *G03G 15/206* (2013.01); *G03G 15/2064* (2013.01); *G03G 2215/2003* (2013.01); *G03G 2215/2074* (2013.01)

(58) Field of Classification Search
CPC ..... G03G 15/206; G03G 15/2064; G03G 2115/2003; G03G 2115/2074
See application file for complete search history.

(56) References Cited

U.S. PATENT DOCUMENTS 4,232,959 A * 11/1980 Ateya ..... G03G 15/2064 219/216
6,580,894 B1 * 6/2003 Kobashigawa .... G03G 15/2064 219/216

(Continued)

FOREIGN PATENT DOCUMENTS

JP 2006-048005 2/2006
JP 2007-155951 6/2007

(Continued)

*Primary Examiner* — David J Bolduc
(74) *Attorney, Agent, or Firm* — Harness, Dickey & Pierce, P.L.C.

(57) ABSTRACT

An image forming apparatus includes a pressing device, an apparatus body, an opening body, and a vibration insulator. The pressing device housed in the apparatus body is configured to press a pressing body to a pressing target body. The opening body is configured to open and close to the apparatus body. The opening body presses a pressing target portion of the apparatus body, at a first pressing portion to cancel a pressing state of the pressing device by opening of the opening body and at a second pressing portion to enter the pressing state of the pressing device by closing of the opening body. The vibration insulator is provided on at least one of the pressing target portion and the second pressing portion, at a contact portion at which the pressing target portion contacts the second pressing portion when the first pressing portion cancels the pressing state.

7 Claims, 6 Drawing Sheets

(56) References Cited

U.S. PATENT DOCUMENTS 8,023,861 B2 * 9/2011 Yoshinaga ..... G03G 15/2035 399/122
8,073,375 B2 * 12/2011 Hiraoka ..... G03G 15/2032 399/122
2003/0118382 A1 * 6/2003 Tomatsu ..... G03G 15/2064 399/328
2005/0141914 A1 * 6/2005 Hiraoka ..... G03G 15/2057 399/69
2006/0002737 A1 * 1/2006 Shinshi ..... G03G 15/2035 399/122
2006/0008282 A1 * 1/2006 Aratachi ..... G03G 15/2064 399/33
2006/0216060 A1 * 9/2006 Kuwata ..... G03G 15/234 399/110
2006/0239715 A1 * 10/2006 Lee ..... G03G 15/2035 399/122
2008/0085140 A1 4/2008 Kajiyama et al.
2008/0310895 A1 * 12/2008 Masuda ..... G03G 15/2064 399/331
2009/0010680 A1 * 1/2009 Nanno ..... G03G 15/20 399/122
2009/0067902 A1 * 3/2009 Yoshinaga ..... G03G 15/2032 399/329
2009/0123202 A1 * 5/2009 Yoshinaga ..... G03G 15/2032 399/329
2009/0166956 A1 7/2009 Kajiyama
2010/0158553 A1 * 6/2010 Ueno ..... G03G 15/2064 399/67
2010/0232848 A1 * 9/2010 Naitoh ..... G03G 15/2028 399/323
2011/0013973 A1 1/2011 Kusumi et al.
2012/0177422 A1 * 7/2012 Nanno ..... G03G 15/2064 399/329
2012/0275834 A1 * 11/2012 Naitoh ..... G03G 15/2064 399/329
2013/0064586 A1 * 3/2013 Adachi ..... G03G 15/2007 399/329
2014/0093288 A1 4/2014 Naitoh et al.
2014/0099146 A1 4/2014 Fujii et al.
2016/0347560 A1 * 12/2016 Murata ..... B65H 3/0684
2017/0343942 A1 11/2017 Okamoto et al.

FOREIGN PATENT DOCUMENTS

JP 2010-032885 2/2010
JP 2015-041093 3/2015
JP 2017-215450 12/2017

* cited by examiner

IMAGE FORMING APPARATUS INCORPORATING PRESSING DEVICE

CROSS-REFERENCE TO RELATED APPLICATIONS

This patent application is based on and claims priority pursuant to 35 U.S.C. § 119(a) to Japanese Patent Application Nos. 2018-140954, filed on Jul. 27, 2018, and 2018-235156, filed on Dec. 17, 2018, in the Japan Patent Office, the entire disclosure of each of which is hereby incorporated by reference herein.

BACKGROUND

Technical Field

This disclosure relates to an image forming apparatus incorporating a pressing device.

Related Art

Various types of image forming apparatuses are known to include a pressing mechanism to press a pressing body against a pressing target body, and an opening member capable of opening and closing with respect to an apparatus body that includes the pressing mechanism. In such image forming apparatuses, as the opening member is moved to open, a first pressing portion of the opening member is brought to press a pressing target portion of the apparatus body, and consequently the pressing mechanism is released from a pressing state. By contrast, as the opening member is moved to close, a second pressing portion of the pressing member is brought to press the pressing target portion of the apparatus body, and consequently the pressing mechanism enters the pressing state.

SUMMARY

At least one aspect of this disclosure provides an image forming apparatus including a pressing device, an apparatus body, an opening body, and a vibration insulator. The pressing device is configured to press a pressing body to a pressing target body. The apparatus body houses the pressing device and has a pressing target portion. The opening body is configured to open and close with respect to the apparatus body and includes a first pressing portion and a second pressing portion. The first pressing portion of the opening body is configured to press the pressing target portion of the apparatus body by opening of the opening body to cancel a pressing state of the pressing device. The second pressing portion of the opening body is configured to press the pressing target portion of the apparatus body by closing of the opening body to enter the pressing state of the pressing device. The vibration insulator is provided on at least one of the pressing target portion and the second pressing portion, at a contact portion to which the pressing target portion is moved to contact the second pressing portion when the first pressing portion cancels the pressing state of the pressing device.

BRIEF DESCRIPTION OF THE SEVERAL VIEWS OF THE DRAWINGS

An exemplary embodiment of this disclosure will be described in detail based on the following figured, wherein.

DETAILED DESCRIPTION

Figure 1:
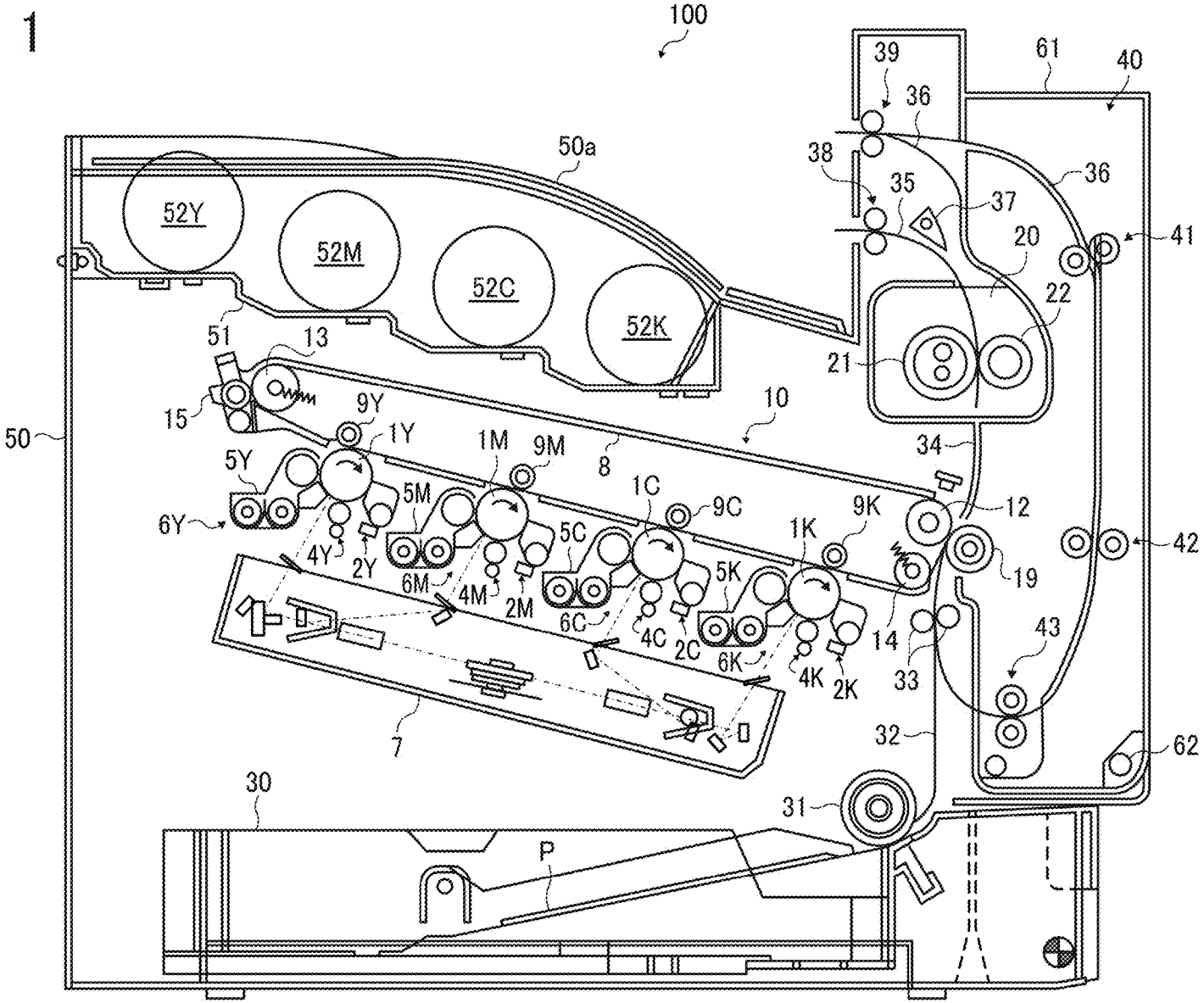
FIG. 1 is a schematic view illustrating a configuration of an image forming apparatus according to an embodiment of this disclosure.

It will be understood that if an element or layer is referred to as being "on", "against", "connected to" or "coupled to" another element or layer, then it can be directly on, against, connected or coupled to the other element or layer, or intervening elements or layers may be present. In contrast, if an element is referred to as being "directly on", "directly connected to" or "directly coupled to" another element or layer, then there are no intervening elements or layers present. Like numbers referred to like elements throughout. As used herein, the term "and/or" includes any and all combinations of one or more of the associated listed items.

Spatially relative terms, such as "beneath", "below", "lower", "above", "upper" and the like may be used herein for ease of description to describe one element or feature's relationship to another element(s) or feature(s) as illustrated in the figures. It will be understood that the spatially relative terms are intended to encompass different orientations of the device in use or operation in addition to the orientation depicted in the figures. For example, if the device in the figures is turned over, elements describes as "below" or "beneath" other elements or features would then be oriented "above" the other elements or features. Thus, term such as "below" can encompass both an orientation of above and below. The device may be otherwise oriented (rotated 90 degrees or at other orientations) and the spatially relative descriptors herein interpreted accordingly.

Although the terms first, second, etc. may be used herein to describe various elements, components, regions, layers and/or sections, it should be understood that these elements, components, regions, layer and/or sections should not be limited by these terms. These terms are used to distinguish one element, component, region, layer or section from another region, layer or section. Thus, a first element, component, region, layer or section discussed below could be termed a second element, component, region, layer or section without departing from the teachings of the present disclosure.

The terminology used herein is for describing particular embodiments and examples and is not intended to be limiting of exemplary embodiments of this disclosure. As used herein, the singular forms "a", "an" and "the" are intended to include the plural forms as well, unless the context clearly indicates otherwise. It will be further understood that the terms "includes" and/or "including", when used in this specification, specify the presence of stated features, integers, steps, operations, elements, and/or components, but do not preclude the presence or addition of one or more other features, integers, steps, operations, elements, components, and/or groups thereof.

Descriptions are given, with reference to the accompanying drawings, of examples, exemplary embodiments, modification of exemplary embodiments, etc., of an image forming apparatus according to exemplary embodiments of this disclosure. Elements having the same functions and shapes are denoted by the same reference numerals throughout the specification and redundant descriptions are omitted. Elements that do not demand descriptions may be omitted from the drawings as a matter of convenience. Reference numerals of elements extracted from the patent publications are in parentheses so as to be distinguished from those of exemplary embodiments of this disclosure.

This disclosure is applicable to any image forming apparatus, and is implemented in the most effective manner in an electrophotographic image forming apparatus.

In describing preferred embodiments illustrated in the drawings, specific terminology is employed for the sake of clarity. However, the disclosure of this disclosure is not intended to be limited to the specific terminology so selected and it is to be understood that each specific element includes any and all technical equivalents that have the same function, operate in a similar manner, and achieve a similar result.

Referring now to the drawings, wherein like reference numerals designate identical or corresponding parts throughout the several views, preferred embodiments of this disclosure are described.

Now, a description is given of a basic configuration of an electrophotographic image forming apparatus 100 for forming images by ectrophotography, according to an embodiment of this disclosure. It is to be noted that, hereinafter, the electrophotographic image forming apparatus 100 is referred to as the image forming apparatus 100.

It is to be noted that elements (for example, mechanical parts and components) having the same functions and shapes are denoted by the same reference numerals throughout the specification and redundant descriptions are omitted.

FIG. 1 is a schematic view illustrating a configuration of the image forming apparatus 100 according to an embodiment of this disclosure.

The image forming apparatus 100 may be a copier, a facsimile machine, a printer, a multifunction peripheral or a multifunction printer (MFP) having at least one of copying, printing, scanning, facsimile, and plotter functions, or the like. According to the present example, the image forming apparatus 100 is an electrophotographic copier that forms toner images on recording media by electrophotography.

It is to be noted in the following examples that: the term "image forming apparatus" indicates an apparatus in which an image is formed on a recording medium such as paper, OHP (overhead projector) transparencies, OHP film sheet, thread, fiber, fabric, leather, metal, plastic, glass, wood, and/or ceramic by attracting developer or ink thereto; the term "image formation" indicates an action for providing (i.e., printing) not only an image having meanings such as texts and figures on a recording medium but also an image having no meaning such as patterns on a recording medium; and the term "sheet" is not limited to indicate a paper material but also includes the above-described plastic material (e.g., an OHP sheet), a fabric sheet and so forth, and is used to which the developer or ink is attracted. In addition, the "sheet" is not limited to a flexible sheet but is applicable to a rigid plate-shaped sheet and a relatively thick sheet.

Further, size (dimension), material, shape, and relative positions used to describe each of the components and units are examples, and the scope of this disclosure is not limited thereto unless otherwise specified.

Further, it is to be noted in the following examples that: the term "sheet conveying direction" indicates a direction in which a recording medium travels from an upstream side of a sheet conveying path to a downstream side thereof; the term "width direction" indicates a direction basically perpendicular to the sheet conveying direction.

In FIG. 1, the image forming apparatus 100 includes four process cartridges 6Y, 6M, 6C, and 6K to form yellow (Y), magenta (M), cyan (C), and black (K) toner images, respectively. The configurations of the process cartridges 6Y, 6M, 6C, and 6K are basically identical to each other, except that the process cartridges 6Y, 6M, 6C, and 6K include toners of different colors (Y toner, M toner, C toner, and K toner) as image forming substances. Each of the process cartridges 6Y, 6M, 6C, and 6K is replaced at the end of the service life.

Figure 2:
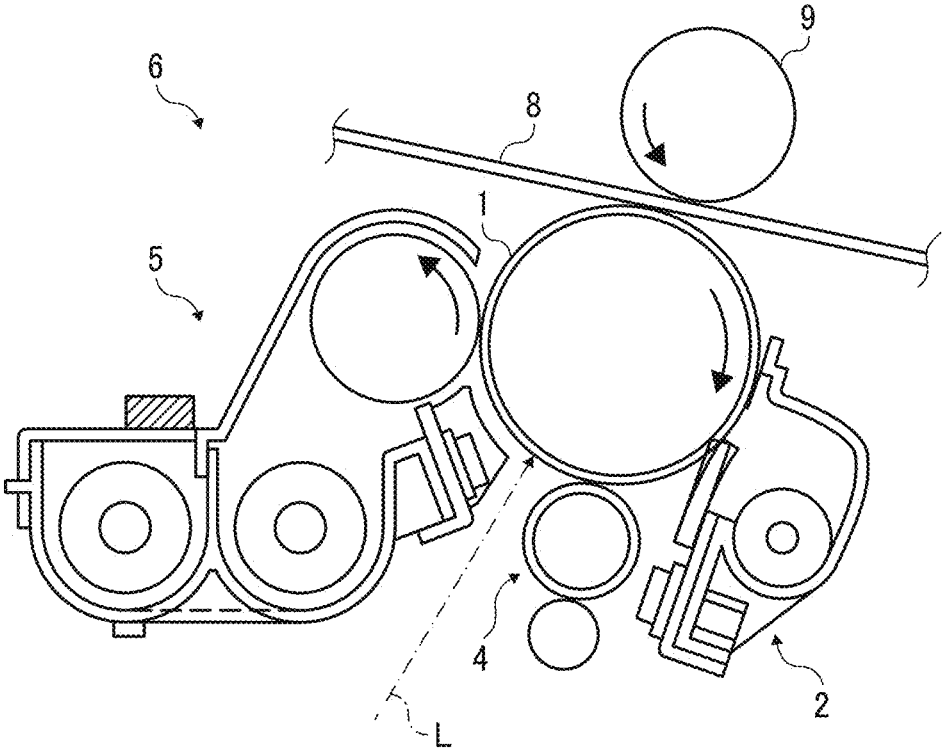
FIG. 2 is an enlarged view illustrating a process cartridge for a single color image of the image forming apparatus and a configuration around the process cartridge.

FIG. 2 is an enlarged view illustrating one process cartridge 6 and a configuration around the process cartridge. It is to be noted that the configuration of the process cartridge 6 in FIG. 2 corresponds the configuration of any of the process cartridges 6Y, 6M, 6C, and 6K. Therefore, in FIG. 2, the reference numerals of units and components are described without suffixes, Y, M, C, and K.

The process cartridge 6 of the image forming apparatus 100 includes a drum-shaped photoconductor 1 (i.e., drum-shaped photoconductors 1Y, 1M, 1C, and 1K), a drum cleaning device 2 (i.e., drum cleaning devices 2Y, 2M, 2C, and 2K), a static eliminating device, a charging device 4 (i.e., charging devices 4Y, 4M, 4C, and 4K), and a developing device 5 (i.e., developing devices 5Y, 5M, 5C, and 5K). The process cartridge 6 that functions as an image forming device is detachably attachable to an apparatus body of the image forming apparatus 100, and consumable parts of the process cartridge 6 are be replaced together at one time.

Referring back to FIG. 1, an optical writing device 7 that functions as a latent image forming device is disposed below the process cartridges 6Y, 6M, 6C, and 6K.

The optical writing device 7 emits respective laser light beams L based on image data, toward the drum-shaped photoconductors 1Y, 1M, 1C, and 1K of the process cartridges 6Y, 6M, 6C, and 6K, respectively, so as to optically expose the surfaces of the drum-shaped photoconductors 1Y, 1M, 1C, and 1K. Due to this optical exposure, respective electrostatic latent images are formed on the surfaces of the drum-shaped photoconductors 1Y, 1M, 1C, and 1K. It is to be noted that the optical writing device 7 causes the laser light beams L emitted by a light source to reflect on a polygon mirror that is rotated by a motor, and the laser light beams L are sent to the drum-shaped photoconductors 1Y, 1M, 1C, and 1K via multiple optical lenses and mirrors.

In the process cartridge 6 in FIG. 2, the surface of the drum-shaped photoconductor 1 is rotated in a clockwise direction by a drive unit, and is uniformly charged by the charging device 4. After the charging device 4 has uniformly charged the surface of the drum-shaped photoconductor 1, the laser light beam L is emitted by the optical writing device 7 toward the drum-shaped photoconductor 1, so that the surface of the drum-shaped photoconductor 1 is optically scanned to form an electrostatic latent image of each single color toner. The electrostatic latent image formed on the surface of the drum-shaped photoconductor 1 is developed by the developing device 5 into a visible toner image by a corresponding single color developer including magnetic carrier particles and non-magnetic toner. Then, the toner image is primarily transferred onto a surface of an intermediate transfer belt 8.

Residual toner remaining on the surface of the drum-shaped photoconductor 1 is removed by the drum cleaning device 2 after the above-described primary transfer process. Then, residual electric charge remaining on the surface of the drum-shaped photoconductor 1 is electrically discharged and removed by the static eliminating device. This removal of static electricity initializes the surface of the drum-shaped photoconductor 1, so as to be prepared for a subsequent image formation. As previously described, the above-described detailed operations are performed in each of the process cartridges 6Y, 6C, 6M, and 6K. For example, respective toner images are developed on the respective surfaces of the drum-shaped photoconductors 1Y, 1C, 1M, and 1K and are then sequentially transferred onto the surface of the intermediate transfer belt 8 to form a composite color image.

The image forming apparatus 100 further includes a sheet container below the optical writing device 7. The sheet container includes a sheet cassette 30 and a sheet feed roller 31 that is provided to the sheet cassette 30. The sheet cassette 30 contains (loads) multiple transfer sheets P that function as sheet or recording media, in layers. The sheet feed roller 31 is in contact with an uppermost transfer sheet P that is placed on top of the multiple transfer sheets P. When the drive unit rotates the sheet feed roller 31 in a counterclockwise direction in FIG. 1, the uppermost transfer sheet P is fed from the sheet cassette 30 toward a sheet conveyance passage 32.

A pair of registration rollers 33 is disposed near a terminal end of the sheet conveyance passage 32. The pair of registration rollers 33 rotates rollers to grip the transfer sheet P. Immediately after the rollers of the pair of registration rollers 33 grip the transfer sheet P, the pair of registration rollers 33 stops rotating temporarily. Then, after an appropriate time has elapsed, the pair of registration rollers 33 starts feeding the transfer sheet P toward a secondary transfer nip region.

An intermediate transfer unit 10 is disposed above the process cartridges 6Y, 6M, 6C, and 6K in FIG. 1. The intermediate transfer unit 10 includes an intermediate transfer belt 8 that functions as an intermediate transfer body. The intermediate transfer belt 8 rotates endlessly while being stretched. The intermediate transfer unit 10 includes the intermediate transfer belt 8, a secondary transfer bias roller 19, and a belt cleaning device 15. The intermediate transfer unit 10 further includes four primary transfer bias rollers 9Y, 9C, 9M, and 9K, a secondary transfer backup roller 12, a cleaning backup roller 13, and a tension roller 14.

The intermediate transfer belt 8 is stretched by the above-described rollers and is rotated endlessly by at least one of the above-described rollers in the counterclockwise direction in FIG. 1. The primary transfer bias rollers 9Y, 9C, 9M, and 9K grip the intermediate transfer belt 8, which is rotated endlessly, together with the photoconductors 1Y, 1C, 1M, and 1K, respectively, thereby forming respective primary transfer nip regions.

In this configuration of the present embodiment, each of the primary transfer bias rollers 9Y, 9M, 9C, and 9K applies a transfer bias having a polarity opposite the toner polarity (for example, a positive polarity) to the back face of the intermediate transfer belt 8 (i.e., an inner circumferential surface of the loop of the intermediate transfer belt 8). The rollers in this configuration except the primary transfer bias rollers 9Y, 9M, 9C, and 9K are electrically grounded.

In the course in which a yellow toner image formed on the photoconductor 1Y, a magenta toner image formed on the photoconductor 1M, a cyan toner image formed on the photoconductor 1C, and a black toner image formed on the photoconductor 1K sequentially pass the primary transfer nip regions along with endless movement of the intermediate transfer belt 8, the yellow, magenta, cyan, and black toner images are sequentially transferred onto a surface of the intermediate transfer belt 8 in layers as primary transfer. Accordingly, a four-color superimposed toner image (hereinafter, referred to as a "four-color toner image") is formed on the surface of the intermediate transfer belt 8.

The secondary transfer backup roller 12 grips the intermediate transfer belt 8 with the secondary transfer bias roller 19, thereby forming a secondary transfer nip region. The four-color toner image formed on the surface of the intermediate transfer belt 8 functions as a visible image and is transferred onto the transfer sheet P in the secondary transfer nip region as secondary transfer. The four-color toner image thus transferred is merged together with the white color of the transfer sheet P to form a full-color toner image. After passing through the secondary transfer nip region, residual toner that has not been transferred onto the transfer sheet P remains on the intermediate transfer belt 8. The residual toner is removed and cleaned by the belt cleaning device 15.

After the four-color toner image has been collectively transferred onto the transfer sheet P in the secondary transfer nip region, the transfer sheet P travels through a post-transfer conveyance passage 34 to a fixing device 20 that functions as a sheet conveying device. The fixing device 20 includes a fixing roller that is a rotary body functioning as a pressing target body and a pressure roller that is a rotary body functioning as a pressing body.

Specifically, the fixing device 20 includes a fixing roller 21 and a pressure roller 22. The fixing roller 21 functions as a fixing body to include a heat source such as a halogen lamp inside the fixing roller 21. The pressure roller 22 functions as a pressing body to rotate while contacting the fixing roller 21 with a predetermined pressure. The fixing roller 21 and the pressure roller 22 form a fixing nip region by contacting to each other. The transfer sheet P that has been conveyed to the fixing device 20 is gripped in the fixing nip region to bring an unfixed toner image carrying face to closely contact with the fixing roller 21. Then, toner in the unfixed toner image melts by application of heat and pressure, so that the full-color toner image is fixed to the transfer sheet P.

After the full-color image is fixed to the transfer sheet P in the fixing device 20, the transfer sheet P is ejected from the fixing device 20. Then, the transfer sheet P comes close to a branch point of a sheet ejection passage 35 and a pre-reverse sheet conveyance passage 36. A first switching claw 37 is rotatably disposed at the branch point. The first switching claw 37 is rotated to switch the orientation of the transfer sheet P. Specifically, as the leading end of the first switching claw 37 is rotated close to the pre-reverse sheet conveyance passage 36, the direction of the transfer sheet P is set to the sheet ejection passage 35. By contrast, as the leading end of the first switching claw 37 is rotated away from the pre-reverse sheet conveyance passage 36, the direction of the transfer sheet P is set to the pre-reverse sheet conveyance passage 36.

In a case in which the direction of the transfer sheet P is selected to the sheet ejection passage 35 according to the position of the leading end of the first switching claw 37, the transfer sheet P travels through the sheet ejection passage 35 and then the pair of sheet ejecting rollers 38. Thereafter, the transfer sheet P is ejected to the outside of the image forming apparatus 100, being stacked on a sheet stacking portion 50*a* formed on top of an apparatus body 50 of the image forming apparatus 100 By contrast, in a case in which the direction of the transfer sheet P is selected to the pre-reverse sheet conveyance passage 36 according to the position of the leading end of the first switching claw 37, the transfer sheet P travels through the pre-reverse sheet conveyance passage 36 and then enters a nip region of a pair of reverse rollers 39. The pair of reverse rollers 39 conveys the transfer sheet P, which is being gripped in the nip region formed between the rollers of the pair of reverse rollers 39, toward the sheet stacking portion 50*a*. Immediately before the trailing end of the transfer sheet P enters the nip region of the pair of reverse rollers 39, the pair of reverse rollers 39 starts rotating the rollers reversely. According to this reverse rotation of the pair of reverse rollers 39, the transfer sheet P is conveyed in a reverse direction that is an opposite direction of a sheet conveying direction. Consequently, the trailing end of the transfer sheet P enters into the pre-reverse sheet conveyance passage 36 in a reverse unit 40.

The pre-reverse sheet conveyance passage 36 extends curving downwardly in a vertical direction and has a first pair of reverse sheet conveying rollers 41, a second pair of reverse sheet conveying rollers 42, and a third pair of reverse sheet conveying rollers 43 in the pre-reverse sheet conveyance passage 36. The first pair of reverse sheet conveying rollers 41, the second pair of reverse sheet conveying rollers 42, and the third pair of reverse sheet conveying rollers 43 have respective nip regions. The transfer sheet P is conveyed while sequentially passing these nip regions, and therefore the vertical orientation of the transfer sheet P is reversed. After having been vertically reversed, the transfer sheet P is returned to the sheet conveyance passage 32, and then reaches the secondary transfer nip region again. Then, the transfer sheet P enters the secondary transfer nip region while causing a no image side of the transfer sheet P to contact the intermediate transfer belt 8, and therefore a second four-color toner image formed on the intermediate transfer belt 8 is transferred onto the no image side of the transfer sheet P collectively as secondary transfer. Thereafter, the transfer sheet P travels through the post-transfer conveyance passage 34, the fixing device 20, the sheet ejection passage 35, and the pair of sheet ejecting rollers 38 to be stacked on the sheet stacking portion 50*a*. With this reverse conveyance, full color images are formed on both sides of the transfer sheet P.

A bottle container 51 is disposed between the intermediate transfer unit 10 and the sheet stacking portion 50*a* disposed above the intermediate transfer unit 10. The bottle container 51 includes toner bottles 52Y, 52M, 52C, and 52K, each of which functions as a toner container to store yellow toner, magenta toner, cyan toner, and black toner. The toner bottles 52Y, 52M, 52C, and 52K are aligned at an angle slightly inclined to the horizontal direction, and the positions of the toner bottles 52Y 52M, 52C, and 52K are arranged to be higher in the order of Y, M, C, and K. The yellow, magenta, cyan, and black toners stored in the toner bottles 52Y, 52M, 52C, and 52K are supplied appropriately by respective toner supplying units to the developing devices 5Y 5M, 5C, and 5K of the process cartridges 6Y, 6M, 6C, and 6K. The toner bottles 52Y, 52M, 52C, and 52K are detachably attachable to the apparatus body 50 of the image forming apparatus 100, and are independent from the process cartridges 6Y 6M, 6C, and 6K.

Figure 3:
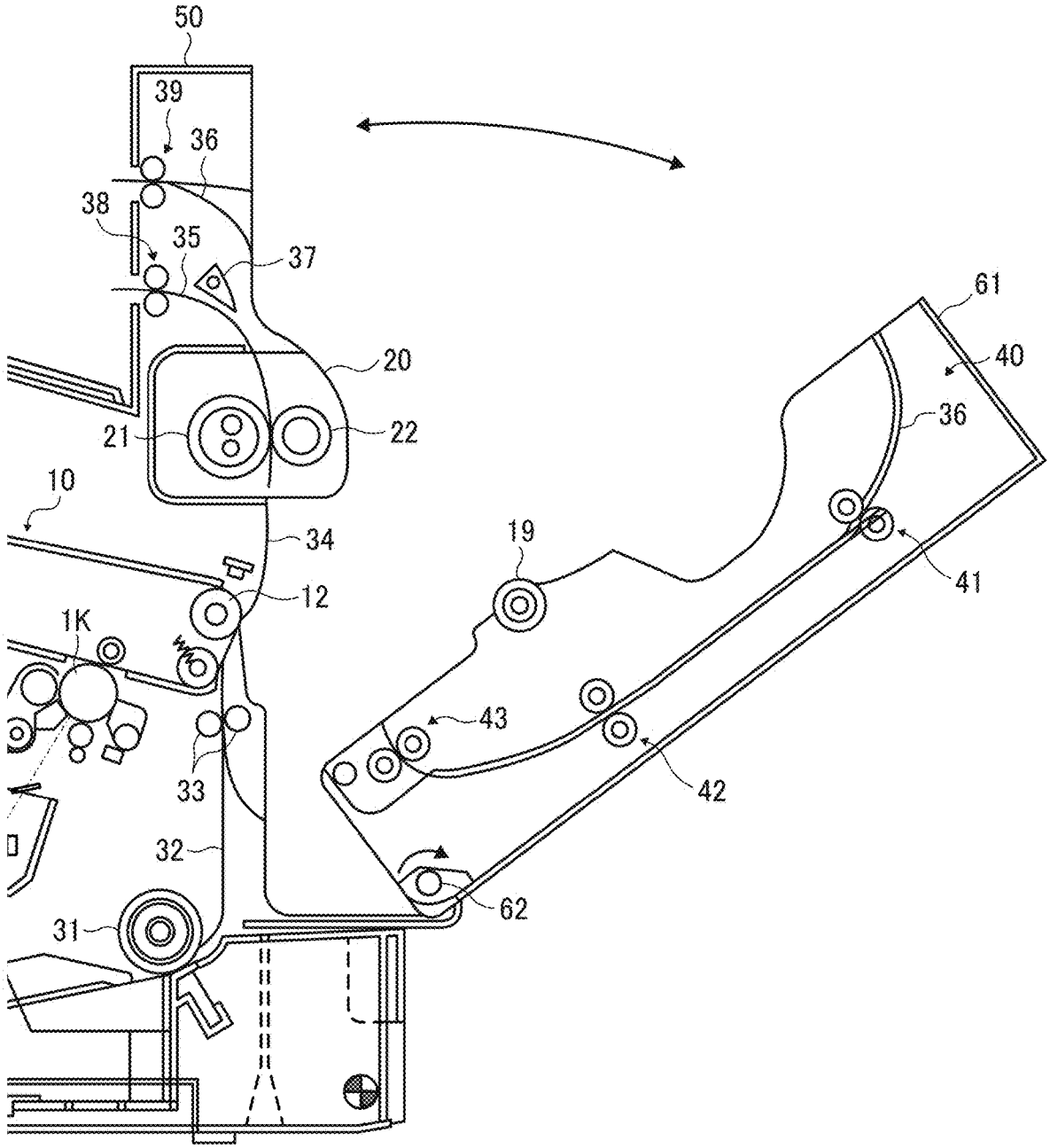
FIG. 3 is a partial enlarged view illustrating a configuration of the image forming apparatus with an apparatus cover being open.

FIG. 3 is a partial enlarged view illustrating a configuration of the image forming apparatus 100 with an apparatus cover being open.

In FIG. 1, an apparatus cover 61 is disposed on the right side of the apparatus body 50 of the image forming apparatus 100 according to the present embodiment of this disclosure. The apparatus cover 61 functions as an opening body to contain the reverse unit 40. As illustrated in FIG. 3, the apparatus cover 61 includes a rotary shaft 62 at the lower part. The apparatus cover 61 is rotatable about the rotary shaft 62 to rotate together with the reverse unit 40, so that apparatus cover 61 opens and closes with respect to apparatus body 50.

As illustrated in FIG. 1, in a state in which the apparatus cover 61 is closed to the apparatus body 50, the post-transfer conveyance passage 34 and a sheet conveyance passage extending from the fixing device 20 to the outside of the image forming apparatus 100 are defined by the apparatus cover 61 and the apparatus body 50. At this time, a cover hook pin 54 that functions as an engaging body fixedly attached to the apparatus body 50 is engaged with a cover hook 64 that functions as an engaging target body mounted on the apparatus cover 61. According to this engagement, the apparatus cover 61 is set to a home position.

By contrast, as illustrated in FIG. 3, in a state in which the apparatus cover 61 is separated from the apparatus body 50 to open, a pressing mechanism 60 causes to release a pressing force of the pressure roller 22 to the fixing roller 21 in the fixing device 20. Details of the pressing mechanism 60 are described below. Accordingly, as illustrated in FIG. 3, the post-transfer conveyance passage 34 and the sheet conveyance passage extending from the fixing device 20 to the outside of the image forming apparatus 100 are exposed to the outside of the image forming apparatus 100. Therefore, a sheet jammed in the post-transfer conveyance passage 34 or the above-described sheet conveyance passage is removed easily.

Now, a description is given of the details of the pressing mechanism 60.

Figure 4B:
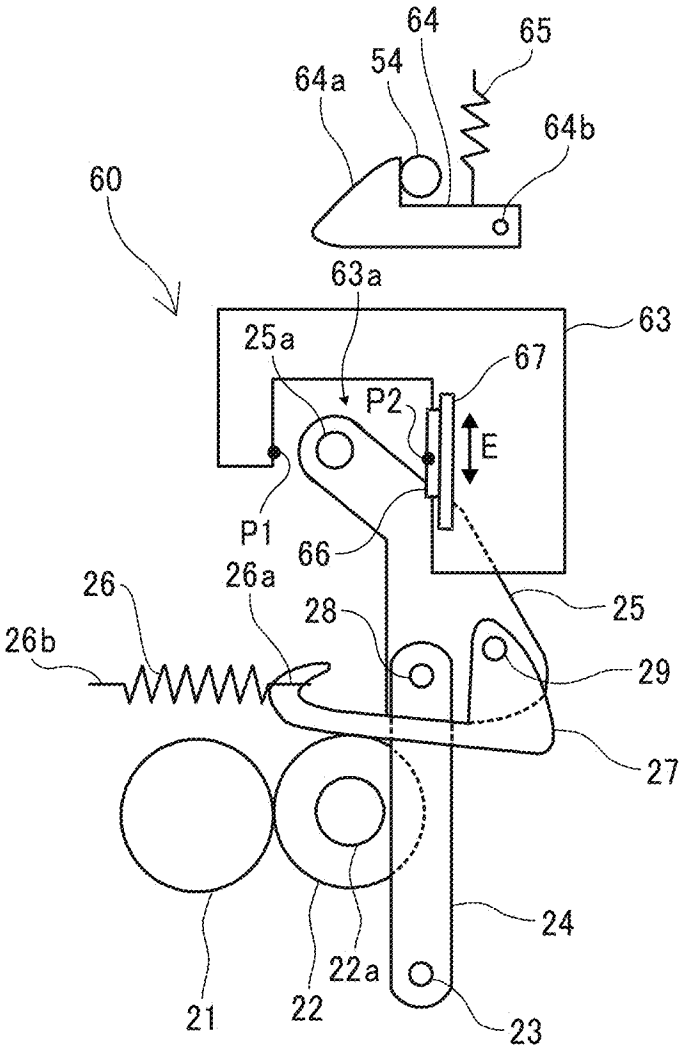
FIG. 4B is a diagram illustrating the configuration and operations of the pressing mechanism when closing the apparatus cover, in a state in which the apparatus cover is completely closed.
Figure 4A:
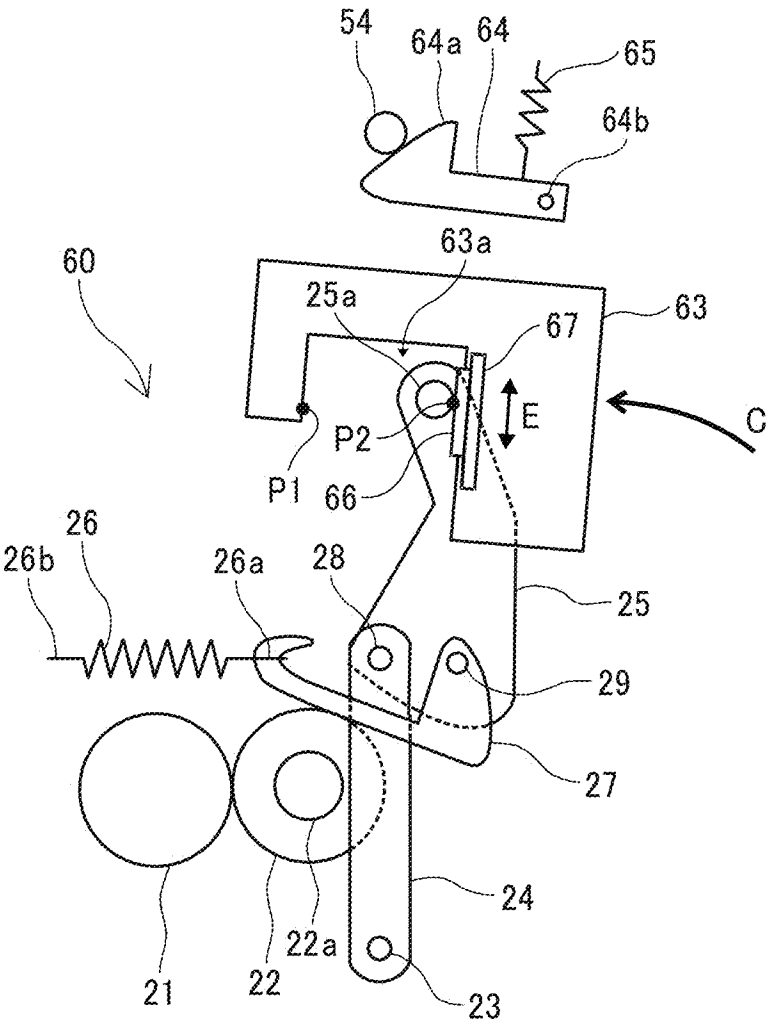
FIG. 4A is a diagram illustrating a configuration and operations of a pressing mechanism when closing the apparatus cover, in a state in which the apparatus cover is being closed.

FIG. 4A is a diagram illustrating a configuration and operations of the pressing mechanism 60 when closing the apparatus cover 61, in a state in which the apparatus cover 61 is being closed. FIG. 4B is a diagram illustrating the configuration and operations of the pressing mechanism 60 when closing the apparatus cover 61, in a state in which the apparatus cover 61 is completely closed.

As illustrated in FIGS. 4A and 4B, the cover hook 64 includes a leading end 64*a* and a fulcrum 64*b*. The leading end 64*a* of the cover hook 64 has a hook shape and is disposed to face the apparatus body 50. The root end of the cover hook 64 is supported by the apparatus cover 61 so that the cover hook 64 rotates about the fulcrum 64*b*. The cover hook 64 is biased by a spring 65 in a rotational direction (i.e., a clockwise direction in FIGS. 4A and 4B). Accordingly, at a balancing position between the biasing force of the spring 65 and the weight of the cover hook 64, when closing apparatus cover 61, as illustrated in FIG. 4A, a sloped face of the leading end 64*a* of the cover hook 64 supported by the apparatus cover 61 contacts the cover hook pin 54 supported by the apparatus body 50 of the image forming apparatus 100.

Thereafter, as the apparatus cover 61 is further moved to close, the cover hook pin 54 slides on the sloped face of the leading end 64*a* of the cover hook 64, the cover hook 64 rotates about the fulcrum 64*b* against the biasing force of the spring 65 in a counterclockwise direction in FIGS. 4A. and 4B, and the sloped face of the leading end 64*a* of the cover hook 64 is pressed downwardly to the lower part of the cover hook pin 54. Then, when the cover hook pin 54 has climbed over the sloped face of the leading end 64*a* of the cover hook 64, the cover hook 64 rotates about the fulcrum 64*b* due to the biasing force of the spring 65 in the counterclockwise direction in FIGS. 4A and 4B, and the cover hook pin 54 is hooked to the inner side of the leading end 64*a* having the hook shape. Accordingly, as illustrated in FIG. 4B, the apparatus cover 61 is set to the home position.

The pressing mechanism 60 according to the present embodiment includes a roller pressing lever 24, a rotation lever 25, a pressure spring 26, a pressing hook 27, and a projection pressing lever 63. The roller pressing lever 24, the rotation lever 25, the pressure spring 26, and the pressing hook 27 are disposed in either the apparatus body 50 or the fixing device 20. The projection pressing lever 63 is attached to the apparatus cover 61. The roller pressing lever 24 is rotatably attached to a support shaft 23 that functions as a fixed support extending from the side face of the apparatus body 50 or the side face of the fixing device 20, to rotate between a pressing position and a pressure releasing position. The roller pressing lever 24 contacts a bearing 22*a* that functions as a support of the pressure roller 22 to press the bearing 22*a* of the pressure roller 22 to the fixing roller 21. By so doing, the pressure roller 22 is pressed to the fixing roller 21. Specifically, when the bearing 22*a* of the pressure roller 22 is pressed toward the fixing roller 21, the bearing 22*a* of the pressure roller 22 is guided to an engagement groove of a side plate that retains the bearing 22*a*, so as to contact the side face of the engagement groove. Accordingly, the pressure roller 22 that is fixed to the bearing 22*a* presses the fixing roller 21 at a predetermined amount of pressure.

In addition, a support pin 28 is mounted on a movable end of the roller pressing lever 24. The rotation lever 25 is rotatably attached to the support pin 28, so that the rotation lever 25 rotates the roller pressing lever 24 between the pressing position and the pressure releasing position. The rotation lever 25 includes a root end on which the support pin 28 is mounted, and a movable end that extends upwardly in FIGS 4A and 4B. The movable end of the rotation lever 25 is pressed by the projection pressing lever 63 on the apparatus cover 61 to rotate.

Further, a support pin 29 is attached to the root end of the rotation lever 25, near the support pin 28. The pressing hook 27 is rotatably attached to the support pin 29. At the movable end of the rotation lever 25, a projection 25*a* that functions as a pressing target portion is disposed extending in the axial direction. The projection 25*a* is pressed to an inner wall face of a recess 63*a* of the projection pressing lever 63.

The pressure spring 26 has one end 26*a* and opposed end 26*b*. The one end 26*a* of the pressure spring 26 that functions as a biasing body is attached to the leading end of the pressing hook 27. The opposed end 26*b* of the pressure spring 26 is attached to the side face of the apparatus body 50 or the side face of the fixing device 20. The pressure spring 26 is a tension spring to pull (bias) the support pin 29 of the rotation lever 25 via the pressing hook 27.

The projection pressing lever 63 is attached to the side plate of the apparatus cover 61. The projection pressing lever 63 rotates about the rotary shaft 62 as a fulcrum, along with rotation (movement) of the apparatus cover 61 that rotates about the rotary shaft 62 as a fulcrum. The projection pressing lever 63 has the recess 63*a* that opens downwardly. In a predetermined range of a rotation angle of the projection pressing lever 63, the projection 25*a* of the rotation lever 25 enters rotatably in the recess 63*a*.

In a case in which the apparatus cover 61 in the open state is closed to the apparatus body 50, the projection pressing lever 63 is moved (rotated) in the counterclockwise direction (i.e., a direction indicated by arrow C) in FIGS. 4A and 4B, along with closing of the apparatus cover 61 to the apparatus cover 61. As the projection pressing lever 63 is moved in the counterclockwise direction, as illustrated in FIG. 4A, a second inner wall face that functions as a second pressing portion of the recess 63*a* of the projection pressing lever 63 (i.e., the inner wall face on the right side of FIGS. 4A and 4B) contacts the projection 25*a* of the rotation lever 25 at a point P2 in FIG. 4A. When the projection pressing lever 63 is further moved in the counterclockwise direction in FIG. 4B, the second inner wall face of the recess 63*a* of the projection pressing lever 63 presses the projection 25*a* of the rotation lever 25 in the counterclockwise direction in FIG. 4B.

As the projection 25*a* of the rotation lever 25 is pressed to move in the counterclockwise direction in FIG. 4B, the rotation lever 25 rotates about the support pin 28 at the movable end of the roller pressing lever 24 in the counterclockwise direction in FIG. 4B. According to this rotation of the rotation lever 25, the support pin 29 on the rotation lever 25 also rotates about the support pin 28 at the movable end of the roller pressing lever 24 in the counterclockwise direction in FIG. 4B. As a result, the biasing force of the pressure spring 26 acting on the support pin 29 is directed directly to the support pin 28 on the movable end of the roller pressing lever 24 or in a direction slightly away from the support pin 28. Accordingly, the entire biasing force of the pressure spring 26 or the substantially entire biasing force of the pressure spring 26 biases the support pin 28 on the movable end of the roller pressing lever 24, and therefore biases the roller pressing lever 24 about the support shaft 23 in the counterclockwise direction (i.e., the direction to bias the pressure roller 22 to the pressing position) in FIG. 4B.

Here, the rotation lever 25 is restricted to rotate in the counterclockwise direction in FIG. 4B about the support pin 28 on the movable end of the roller pressing lever 24, from a rotating position (in FIG. 4B) at which the rotation lever 25 is located when the apparatus cover 61 is set to the home position of apparatus body 50. That is, the projection 25*a* provided to the movable end of the rotation lever 25 is prohibited to move to the left in FIG. 4B, from the position illustrated in FIG. 4B. Therefore, in a case in which the apparatus cover 61 is set to the home position of the apparatus body 50, even when the biasing force to the support pin 28 is directed to a direction slightly away from the support pin 28 to generate a moment of rotation to rotate the rotation lever 25 about the support pin 28 in the counterclockwise direction in FIG. 4B, the pressing state in which the pressure roller 22 is pressed against the fixing roller 21 is maintained.

Figure 5B:
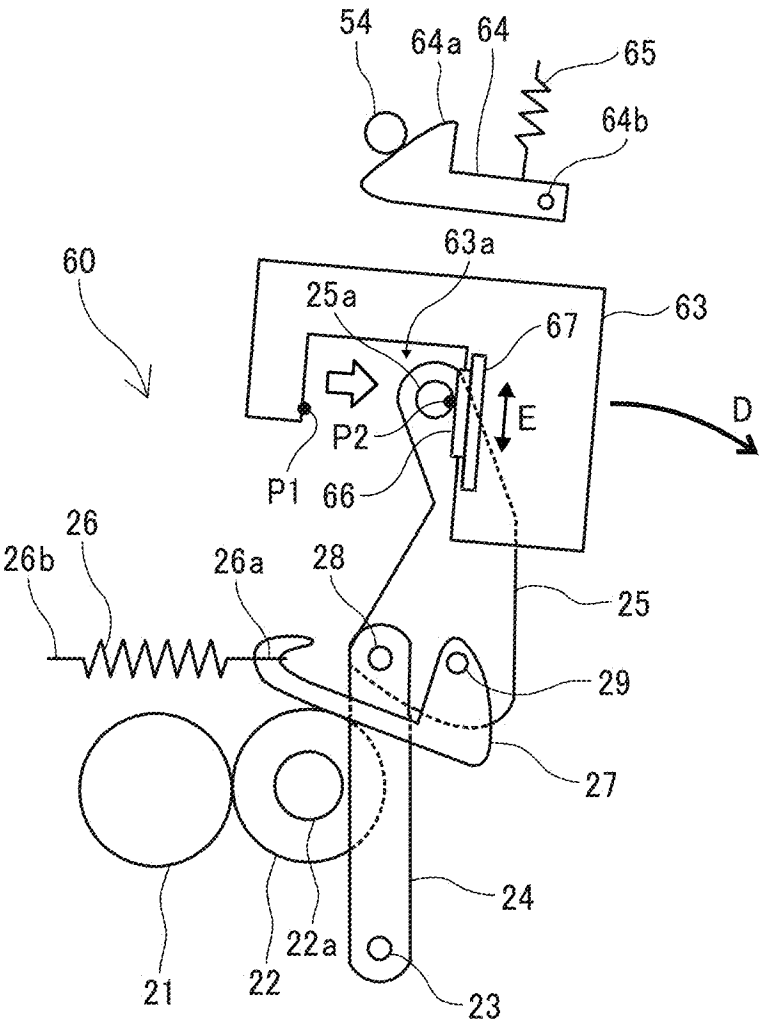
FIG. 5B is a diagram illustrating the configuration and operations of the pressing mechanism when opening the apparatus cover, in a state in which the pressing state is released (cancelled)
Figure 5A:
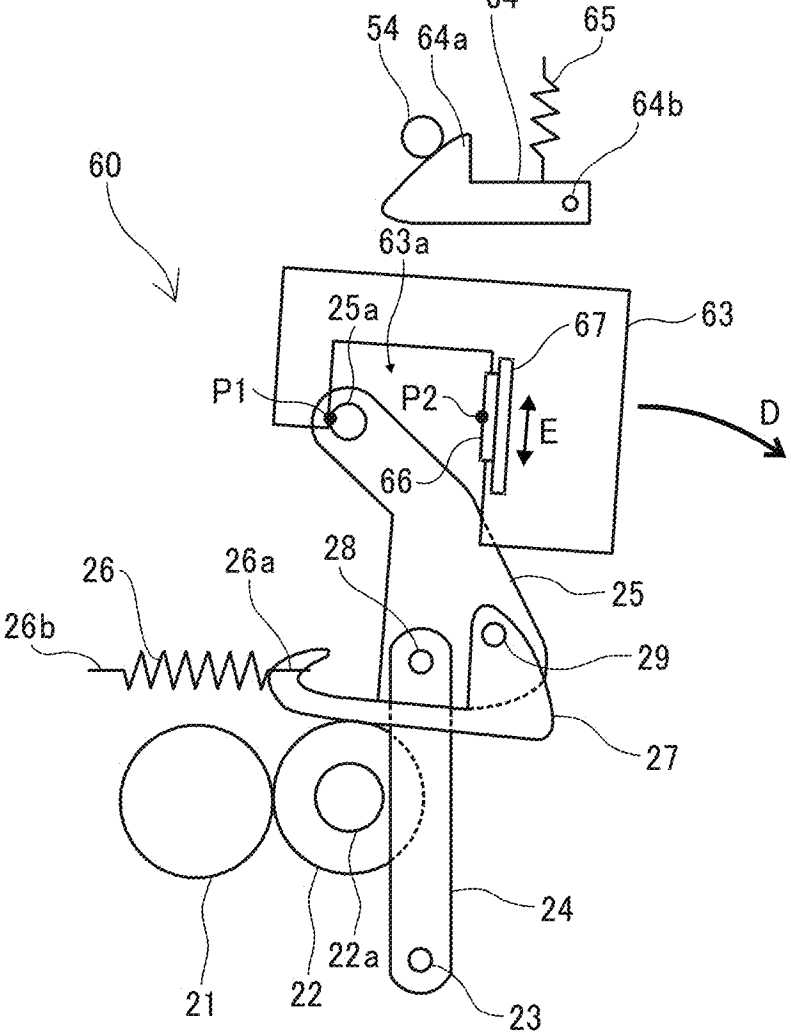
FIG. 5A is a diagram illustrating the configuration and operations of the pressing mechanism when opening the apparatus cover, in a state in which the apparatus cover starts to open and a projection pressing lever contacts a projection of a rotation lever.

FIG. 5A is a diagram illustrating the configuration and operations of the pressing mechanism 60 when opening the apparatus cover 61, in a state in which the apparatus cover 61 starts to open and the projection pressing lever 63 contacts the projection 25*a* of the rotation lever 25, and FIG. 5B is a diagram illustrating the configuration and operations of the pressing mechanism 60 when opening the apparatus cover 61, in a state in which the pressing state is released (cancelled).

When the apparatus cover 61 is opened from the home position of the apparatus body 50, the projection pressing lever 63 is moved in the clockwise direction (indicated by arrow D) in FIGS. 5A and 5B along with opening of the apparatus cover 61. As the projection pressing lever 63 is moved in the clockwise direction in FIGS. 5A and 5B, a first inner wall face that functions as a first pressing portion of the recess 63*a* of the projection pressing lever 63 (i.e., an inner wall face on the left side of FIG. 5A) contacts the projection 25*a* of the rotation lever 25 at a contact point P1, as illustrated in FIG. 5A. Then, as the projection pressing lever 63 is further moved in the clockwise direction in FIGS. 5A and 5B, the first inner wall face of the recess 63*a* of the projection pressing lever 63 presses the projection 25*a* of the rotation lever 25 in the clockwise direction in FIGS. 5A and 5B.

When the projection 25*a* of the rotation lever 25 is pressed and moved in the clockwise direction in FIGS. 5A and 5B, the rotation lever 25 is rotated about the support pin 28 on the movable end of the roller pressing lever 24 in the clockwise direction in FIGS. 5A and 5B. According to this rotation of the rotation lever 25, the support pin 29 on the rotation lever 25 also rotates about the support pin 28 on the movable end of the roller pressing lever 24 in the clockwise direction in FIGS. 5A and 5B. As a result, the biasing force of the pressure spring 26 acting on the support pin 29 is directed in the direction away from the support pin 28, so as to generate the moment of rotation to rotate the rotation lever 25 about the support pin 28 in the clockwise direction of FIGS. 5A and 5B.

When this moment of rotation is generated, the rotation lever 25 is rotated about the support pin 28 in the clockwise direction in FIGS. 5A and 5B. Accordingly, the projection 25*a* of the rotation lever 25 that has been in contact with the first inner wall face of the recess 63*a* of the projection pressing lever 63 at the contact point P1 is moved inside the recess 63*a* of the projection pressing lever 63 in the clockwise direction in FIGS. 5A and 56B, to be brought to contact the second inner wall face of the recess 63*a* of the projection pressing lever 63 (i.e., the inner wall face on the right side of 5A and 5B). At this time, the projection 25*a* of the rotation lever 25 contacts strongly or collides the second inner wall face of the recess 63*a* of the projection pressing lever 63 due to the biasing force of the pressure spring 26, resulting in generation of a large sound of collision. In a case in which a user hears such a large sound of collision, the user is likely to take the sound of collision as an erroneous sound to indicate that the image forming apparatus is broken.

In order to address this inconvenience, in the present embodiment, a vibration insulating member 66 is attached to a contact position (on the second inner wall face) of the projection pressing lever 63, at which the projection 25*a* of the rotation lever 25 is moved to contact (collide with) the second inner wall face of the recess 63*a* of the projection pressing lever 63 (i.e., the inner wall face on the right side in FIGS. 5A and 5B) when the pressing state of the pressing mechanism 60 is cancelled (when the pressure of the pressing mechanism 60 is released). With the vibration insulating member 66 attached to the contact position on the projection pressing lever 63, the level of the sound of collision is reduced when compared with a case in which the projection 25*a* of the rotation lever 25 directly contacts (collides with) the second inner wall face of the recess 63*a* of the projection pressing lever 63.

Here, the second inner wall face of the recess 63*a* of the projection pressing lever 63 contacts and presses the projection 25*a* of the rotation lever 25 as the rotation lever 25 is rotated in the counterclockwise direction in FIGS. 5A and 5B, when the apparatus cover 61 is closed to the apparatus body 50, as illustrated in FIG. 4A. At this time, from the start of the contact as illustrated in FIG. 4A until the rotation lever 25 finishes rotating in the counterclockwise direction in FIG. 4A to cause the apparatus cover 61 is set to the home position, as illustrated in FIG. 4B, the projection 25*a* of the rotation lever 25 is relatively moved upwardly while being pressed by the second inner wall face of the recess 63*a* of the projection pressing lever 63 and sliding on the second inner wall face.

Consequently, with the vibration insulating member 66 being fixedly attached to the second inner wall face of the recess 63*a* of the projection pressing lever 63, when closing the apparatus cover 61 to the apparatus body 50 of the image forming apparatus 100, the projection 25*a* of the rotation lever 25 slides on a surface of the vibration insulating member 66 attached to the second inner wall face of the recess 63*a* of the projection pressing lever 63. The vibration insulating member 66 is generally softer than the second inner wall face of the recess 63*a* of the projection pressing lever 63. Therefore, the projection 25*a* bites in the vibration insulating member 66 easily, which increases the sliding resistance. Further, the vibration insulating member 66 generally has a greater frictional resistance to the projection 25*a*, than the second inner wall face of the recess 63*a* of the projection pressing lever 63, which increases the sliding resistance. In a case in which the sliding resistance increases as described above, a greater force is used to close the apparatus cover 61. The increase in the force makes it difficult to close the apparatus cover 61, which is likely to degrade the convenience of a user.

In order to address this inconvenience, the vibration insulating member 66 according to the present embodiment is configured to move along with relative movement of the second inner wall face of the recess 63*a* of the projection pressing lever 63 and the projection 25*a* of the rotation lever 25 when closing the apparatus cover 61. Specifically, the vibration insulating member 66 is disposed on a slide member 67 that is attached to the projection pressing lever 63 to be movable in a direction in which the projection 25*a* of the rotation lever 25 is relatively moved along the surface of the second inner wall face of the recess 63*a* of the projection pressing lever 63 (i.e., a direction indicated by arrow E in FIG. 4B).

Accordingly, when the second inner wall face of the recess 63*a* of the projection pressing lever 63 and the projection 25*a* of the rotation lever 25 move relatively when closing the apparatus cover 61, the vibration insulating member 66 to which the projection 25*a* of the rotation lever 25 contacts together with the projection 25*a* as the slide member 67 moves to the projection pressing lever 63. Since the resistance of movement of the slide member 67 with respect to the projection pressing lever 63 is smaller than the sliding resistance when the vibration insulating member 66 is fixedly attached to the second inner wall face of the recess 63*a* of the projection pressing lever 63, the force to be used for closing the apparatus cover 61 is reduced. Therefore, the apparatus cover 61 is easily closed, and the degradation of user convenience is restrained.

Further, after the second inner wall face of the recess 63*a* of the projection pressing lever 63 finishes pressing the projection 25*a* of the rotation lever 25 via the vibration insulating member 66 and the slide member 67 and when the projection 25*a* of the rotation lever 25 is separated from the vibration insulating member 66, as illustrated in FIG. 4B, the slide member 67 moves downwardly (falls) in FIG. 4B, due to the weight of the slide member 67 and the weight of the vibration insulating member 66. As a result, the position of the vibration insulating member 66 is moved back to the contact position at which the projection 25*a* of the rotation lever 25 contacts (collides with) the second inner wall face of the recess 63*a* of the projection pressing lever 63 when opening the apparatus cover 61. Accordingly, when the apparatus cover 61 is opened again, the projection 25*a* is received appropriately by the vibration insulating member 66 at contact (collision) of the projection 25*a* of the rotation lever 25 with the second inner wall face, and therefore a sound of collision is reduced.

Here, the resistance of movement of the slide member 67 to the projection pressing lever 63 increases due to mechanical aging changes of the slide member 67 caused by repeated use. Therefore, it is likely to be difficult to move the slide member 67. In such a case, even if the projection 25*a* of the rotation lever 25 is separated from the vibration insulating member 66, the slide member 67 cannot move by the weight of the slide member 67 and the weight of the vibration insulating member 66. Therefore, it is likely that the position of the vibration insulating member 66 cannot move back to the contact position at which the projection 25*a* of the rotation lever 25 contacts (collides with) the inner wall face of the recess 63*a* of the projection pressing lever 63 when opening the apparatus cover 61. In particular, in a case in which the vibration insulating member 66 has a relatively small size due to the installation space, if the position of the vibration insulating member 66 cannot move back to the contact position, the vibration insulating member 66 cannot receive the projection 25*a* when the projection 25*a* of the rotation lever 25 contacts the inner wall face of the recess 63*a* of the projection pressing lever 63, and therefore a sound of collision is generated easily. In such a case, another biasing member may be provided to bias the slide member 67 on which the vibration insulating member 66 being attached, in a direction opposite the closing direction of the apparatus cover 61.

Figure 6B:
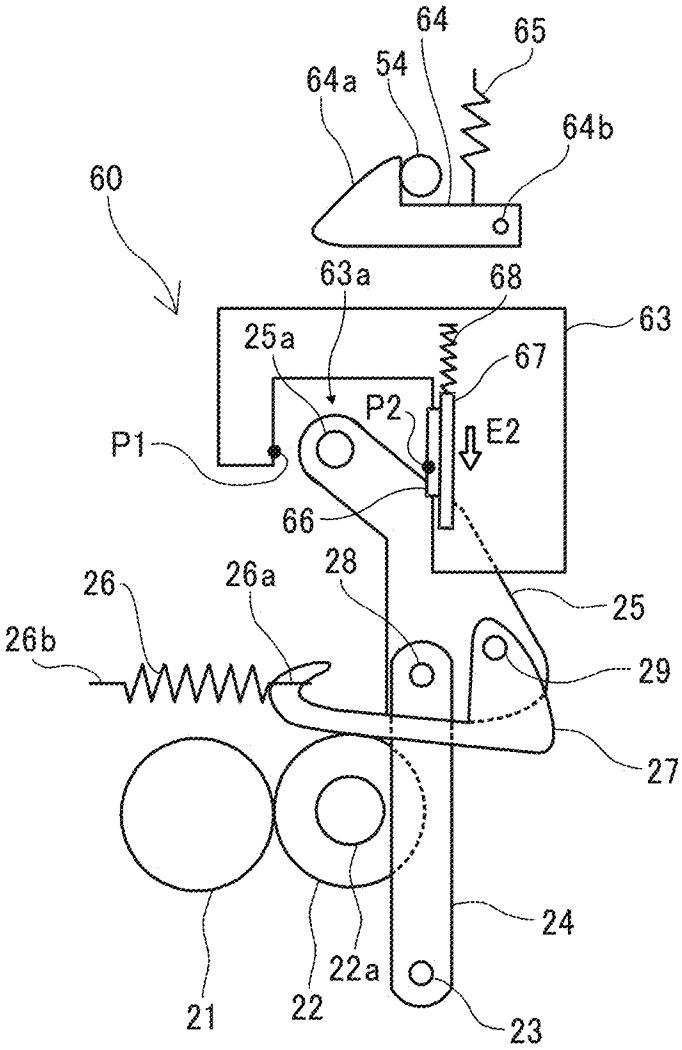
FIG. 6B is a diagram illustrating the configuration and operations of the pressing mechanism when closing the apparatus cover, indicating a position at which the apparatus cover is completely closed (i.e., at which the vibration insulating member has returned to the original position).
Figure 6A:
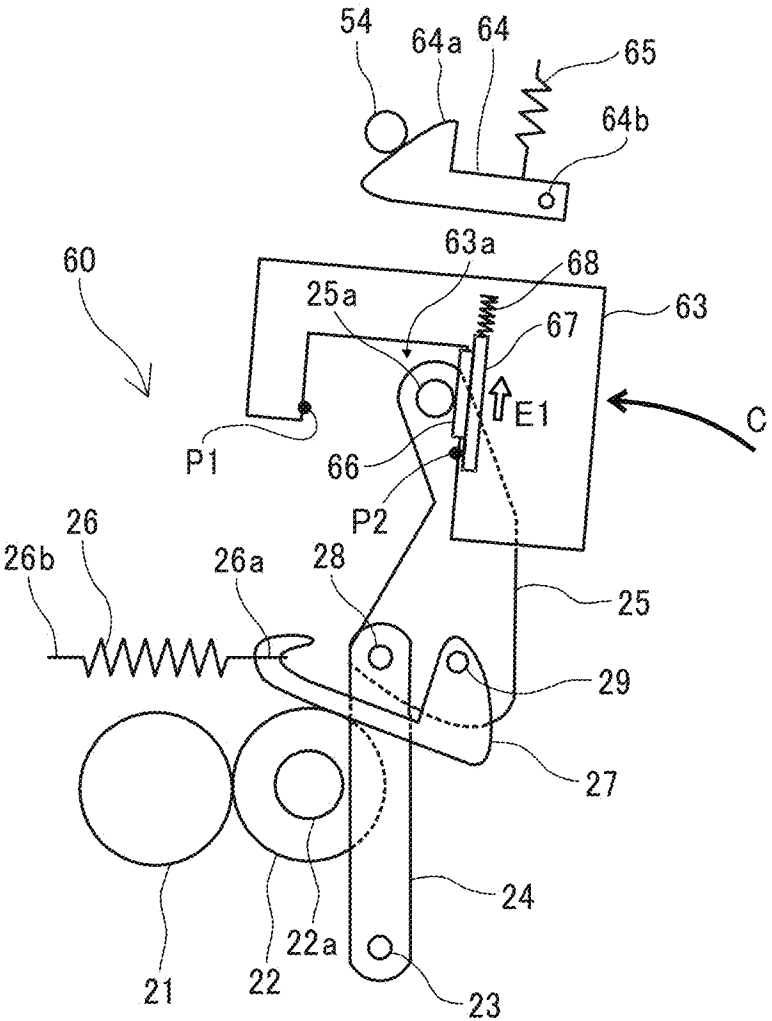
FIG. 6A is a diagram illustrating the configuration and operations of the pressing mechanism when closing the apparatus cover, indicating a position at which a vibration insulating member in contact with the projection of the rotation lever is finished moving in a direction E1 (i.e., a position at which the projection of the rotation lever separates from the vibration insulating member) while the apparatus cover is being moved to close.

FIG. 6A is a diagram illustrating the configuration and operations of the pressing mechanism 60 when closing the apparatus cover 61, indicating a position at which the vibration insulating member 66 in contact with the projection 25*a* of the rotation lever 25 is finished moving in a direction E1 in FIG. 6A (i.e., a position at which the projection 25*a* of the rotation lever 25 is separated from the vibration insulating member 66) while the apparatus cover 61 is being moved to close. FIG. 6B is a diagram illustrating the configuration and operations of the pressing mechanism 60 when closing the apparatus cover 61, indicating a position at which the apparatus cover 61 is completely closed (i.e., at which the vibration insulating member 66 has returned to the home position).

The vibration insulating member 66, to which the projection 25*a* of the rotation lever 25 contacts when closing the apparatus cover 61, is moved by the slide member 67 in the direction indicated by arrow E1 relative to the projection pressing lever 63. By so doing, the position of the vibration insulating member 66 is directed in the direction away from a position P 2 at which the projection 25*a* of the rotation lever 25 contacts (collides with) the inner wall face of the recess 63*a* of the projection pressing lever 63 when the pressure of the pressing mechanism 60 is released, as illustrated in FIG. 6A. Therefore, if the slide member 67 cannot return to the home position when the projection 25*a* of the rotation lever 25 is separated from the vibration insulating member 66, the vibration insulating member 66 cannot receive the projection 25*a* of the rotation lever 25 appropriately when opening the apparatus cover 61, and therefore a sound of collision is generated.

In the present embodiment, the slide member 67 is biased by a spring 68 that functions as a biasing body in a direction, indicated by arrow E2, opposite the direction E1 in which the slide member 67 is moved when the apparatus cover 61 is closed. Therefore, when the projection 25*a* of the rotation lever 25 is separated from the vibration insulating member 66 that has been moved in the direction E1 when closing the apparatus cover 61, the slide member 67 is moved to the previous position by the biasing force of the spring 68 in addition to the weight of the slide member 67 and the weight of the vibration insulating member 66. As a result, the above-described operations reliably prevent the situation in which the vibration insulating member 66 cannot move back to the previous position and the projection 25*a* of the rotation lever 25 is not received appropriately by the vibration insulating member 66 when the pressure of the pressing mechanism 60 is released when opening the apparatus cover 61.

It is to be noted that the amount of the biasing force of the spring 68 is appropriately set in a range in which the force to be used when the apparatus cover 61 is closed is not excessive. In the present embodiment, the slide member 67 is moved back to the previous position by the weight of the slide member 67 and the weight of the vibration insulating member 66. Therefore, the biasing force of the spring 68 may be an auxiliary force and may be a relatively small force.

It is to be noted that the vibration insulating member 66 is attached to the projection pressing lever 63 in the present embodiment but is not limited to this configuration. For example, the vibration insulating member 66 may be attached to the rotation lever 25

Further, in the present embodiment, the pressing mechanism 60 is provided in the fixing device 20 but is not limited to this configuration. For example, in a case in which a pressing mechanism may be provided in a sheet conveying device that conveys a sheet while gripping the sheet between a pressing target body and a pressing body in the pressing state, the same effect is provided as the pressing mechanism 60 in the present embodiment.

Further, the device is not limited to the sheet conveying device but this disclosure is applicable to any device having a configuration in which the pressing state is released (cancelled) when the first pressing portion of the opening body presses a pressing target portion of the apparatus body due to opening of the opening body and the pressing mechanism enters the pressing state when the second pressing portion of the opening body presses the pressing target portion of the apparatus body when closing the apparatus cover to the apparatus body.

The above-described configurations according to the above-descried examples are not limited thereto. This disclosure achieves the following aspects effectively.

Aspect 1.

In Aspect 1, an image forming apparatus (for example, the image forming apparatus 100) includes a pressing device (for example, the pressing mechanism 60), an apparatus body (for example, the apparatus body 50), an opening body (for example, the apparatus cover 61), and a vibration insulator (for example, the vibration insulating member 66). The pressing device is configured to press a pressing body (for example, the pressure roller 22) to a pressing target body (for example, the fixing roller 21). The apparatus body includes the pressing device, and has a pressing target portion (for example, the projection 25*a*). The opening body is configured to open and close with respect to the apparatus body. The opening body includes a first pressing portion at which the opening body presses the pressing target portion of the apparatus body to cancel a pressing state of the pressing unit when opening the opening body and a second pressing portion at which the opening body presses the pressing target portion of the apparatus body to enter the pressing state of the pressing device when closing the opening body. The vibration insulator is provided to at least one of the pressing target portion and the second pressing portion, at a contact portion (for example, the point P2) to which the pressing target portion is moved to contact the second pressing portion when cancelling the pressing state of the pressing device.

According to Aspect 1, when the pressing state of the pressing device is released along with the opening of the opening body, even if the pressing target portion of the apparatus body is moved to contact the second pressing portion of the opening body (that is, a portion to which the pressing target portion of the apparatus body is pressed when closing the opening body), the sound of collision is reduced according to the vibration insulator that is attached to the contact position.

It is to be noted that the vibration insulator may be attached to the pressing target portion, the second pressing portion, or both of the pressing target portion, the second pressing portion.

Aspect 2.

In Aspect 2, in the image forming apparatus (for example, the image forming apparatus 100) according to Aspect 1, the pressing device (for example, the pressing mechanism 60) includes a projection pressing lever (for example, the projection pressing lever 63) that is attached to the opening body (for example, the apparatus cover 61). The projection pressing lever is configured to move along with movement of the opening body and presses the pressing target portion (for example, the projection 25*a*). The projection pressing lever has the first pressing portion and the second pressing portion at positions spaced from each other.

According to this configuration, the image forming apparatus is provided with a more simplified configuration.

Aspect 3.

In Aspect 3, in the image forming apparatus (for example, the image forming apparatus 100) according to Aspect 2, the pressing device (for example, the pressing mechanism 60) further includes a roller pressing lever (for example, the roller pressing lever 24), a rotation lever (for example, the rotation lever 25), and a biasing body (for example, the pressure spring 26). The roller pressing lever has a root end supported by a fixed support (for example, the support shaft 23) of the apparatus body (for example, the apparatus body 50). The roller pressing lever is configured to press a support (for example, the bearing 22*a*) of the pressing body (for example, the pressure roller 22) to rotate the pressing body between a roller pressing position at which the roller pressing lever presses the pressing body and a roller releasing position at which the roller pressing lever moves away from the pressing body. The rotation lever has a root end supported by the roller pressing lever. The rotation lever is configured to rotate the roller pressing lever. The biasing body is configured to bias the rotation lever. The projection pressing lever is configured to press the pressing target portion. The pressing target portion is formed on the rotation lever, extending in an axial direction of the rotation lever. The projection pressing lever is configured to press the pressing target portion of the rotation lever along with closing of the opening body (for example, the apparatus cover 61) to rotate the rotation lever to a position at which the biasing body biases the roller pressing lever to the roller pressing position via the rotation lever. The projection pressing lever is configured to press the pressing target portion of the rotation lever along with opening of the opening body to rotate the rotation lever to a position at which the rotation lever rotates at a movable end of the roller pressing lever due to a biasing force of the biasing body.

In Aspect 3, when the opening body is closed, the biasing body biases the roller pressing lever to the pressing position via the rotation lever, so that the pressing device enters the pressing state. By contrast, when opening the opening body, the projection pressing lever presses the pressing target portion of the rotation lever along with opening of the opening body. By so doing, the rotation lever is rotated to a position at which the rotation lever rotates about the movable end of the roller pressing lever by the biasing force of the biasing body (that is, a position at which the pressure is released). At this time, the moment of rotation is generated about the movable end of the roller pressing lever at the pressing target portion of the rotation lever due to the biasing force of the biasing body. Consequently, the pressing target portion of the rotation lever that has been in contact with the first pressing portion of the projection pressing lever contact the second pressing portion of the projection pressing lever with great force, thereby generating a sound of collision. Accordingly, in Aspect 3, such a sound of collision is reduced even in the above-described configuration.

Aspect 4.

In Aspect 4, in the image forming apparatus (for example, the image forming apparatus 100) according to any one of Aspect 1 through Aspect 3, the vibration insulator (for example, the vibration insulating member 66) is configured to move in response to relative movement of the second pressing portion of the opening body (for example, the apparatus cover 61) to the pressing target portion (for example, the projection 25*a*) of the apparatus body (for example, the apparatus body 50) when closing the opening body.

According to this configuration, even in a case in which the sliding resistance of the vibration insulator and either one of the second pressing portion of the opening body in contact with the vibration insulator and the pressing target portion of the apparatus body in contact with the vibration insulator is relatively high, when the second pressing portion of the opening body and the pressing target portion of the apparatus body are moved as the opening body is being closed, the vibration insulator is moved along with the relative movement. As a result, the inconvenience in which the opening body is difficult to be closed due to an increase in force used to close the opening body is reduced, and therefore a decrease in convenience for user is restrained.

Aspect 5.

In Aspect 5, the image forming apparatus (for example, the image forming apparatus 100) according to Aspect 4 further includes a biasing body (for example, the spring 68) configured to bias the vibration insulator (for example, the vibration insulating member 66) in a direction opposite a closing direction of the opening body (for example, the apparatus cover 61).

When the easiness of movement of the vibration insulator decreases, in other words, when it becomes difficult to move the vibration insulator, the vibration insulator is not moved back to the previous position before the closing of the opening body. Consequently, when the pressing state of the pressing device is released due to the opening of the opening body, the vibration insulator is separated from the position to which the second pressing portion of the opening body contact when the pressing state of the pressing device is released due to the opening of the opening body. Accordingly, it is not likely to reduce the sound of collision.

According to the configuration of Aspect 5, the vibration insulator that has moved when closing the opening body is moved back to the previous position due to the biasing force of the biasing body. Accordingly, the inconvenience in which the vibration insulator is separated from the position to which the second pressing portion of the opening body contacts when the pressing state of the pressing device is released due to the opening of the opening body is avoided, and therefore the sound of collision is reduced stably.

Aspect 6.

In Aspect 6, the image forming apparatus (for example, the image forming apparatus 100) according to any one of Aspect 1 through Aspect 5 further includes a sheet conveying device (for example, the fixing device 20) that is configured to convey a sheet (for example, the transfer sheet P) while gripping the sheet between the pressing body (for example, the pressure roller 22) and the pressing target body (for example, the fixing roller 21) in the pressing state of the pressing device (for example, the pressing mechanism 60).

According to this configuration, in handling a sheet jammed in the sheet conveying device, a sound of collision is lowered even if generated when the pressing device is changed to the pressure releasing state along with the opening of the opening body.

Aspect 7.

In Aspect 7, in the image forming apparatus (for example, the image forming apparatus 100) according to any one of Aspect 1 through Aspect 6, the sheet conveying device is a fixing device (for example, the fixing device 20) that is configured to fix an image on a sheet that is conveyed while being gripped between the pressing body (for example, the pressure roller 22) and the pressing target body (for example, the fixing roller 21).

According to this configuration, in handling a sheet jammed in the fixing device, a sound of collision is lowered even if generated when the pressing device is changed to the pressure releasing state along with the opening of the opening body.

The embodiments described above are presented as an example to implement this disclosure. The embodiments described above are not intended to limit the scope of the invention. These novel embodiments can be implemented in various other forms, and various omissions, replacements, or changes can be made without departing from the gist of the invention. These embodiments and their variations are included in the scope and gist of the invention, and are included in the scope of the invention recited in the claims and its equivalent.

What is claimed is:

1. An image forming apparatus comprising:

a pressing device configured to press a pressing body to a pressing target body;

an apparatus body housing the pressing device and having a pressing target portion;

an opening body configured to open and close with respect to the apparatus body, the opening body including:

a first pressing portion configured to press the pressing target portion of the apparatus body by opening of the opening body to cancel a pressing state of the pressing device; and a second pressing portion configured to press the pressing target portion of the apparatus body by closing of the opening body to enter the pressing state of the pressing device; and a vibration insulator provided on at least one of the pressing target portion and the second pressing portion, at a contact portion to which the pressing target portion is moved to contact the second pressing portion when the first pressing portion cancels the pressing state of the pressing device.

2. The image forming apparatus according to claim 1, wherein the pressing device includes a projection pressing lever attached to the opening body and configured to move along with movement of the opening body and press the pressing target portion, and wherein the projection pressing lever has the first pressing portion and the second pressing portion at positions spaced from each other.

3. The image forming apparatus according to claim 2, wherein the pressing device further includes:

a roller pressing lever having a root end supported by a fixed support of the apparatus body, the roller pressing lever configured to press a support of the pressing body to rotate the pressing body between a roller pressing position at which the roller pressing lever presses the pressing body and a roller releasing position at which the roller pressing lever moves away from the pressing body;

a rotation lever having a root end supported by the roller pressing lever, the rotation lever configured to rotate the roller pressing lever; and a biasing body configured to bias the rotation lever, wherein the projection pressing lever is configured to press the pressing target portion, wherein the pressing target portion is part of the rotation lever, extending in an axial direction of the rotation lever, wherein the projection pressing lever is configured to press the pressing target portion of the rotation lever along with closing of the opening body to rotate the rotation lever to a position at which the biasing body biases the roller pressing lever to the roller pressing position via the rotation lever, and wherein the projection pressing lever is configured to press the pressing target portion of the rotation lever along with opening of the opening body to rotate the rotation lever to a position at which the rotation lever rotates at a movable end of the roller pressing lever due to a biasing force of the biasing body.

4. The image forming apparatus according to claim 1, wherein the vibration insulator is configured to move in response to relative movement of the second pressing portion of the opening body and the pressing target portion of the apparatus body by closing of the opening body.

5. The image forming apparatus according to claim 4, further comprising:

a biasing body configured to bias the vibration insulator in a direction opposite a closing direction of the opening body.

6. The image forming apparatus according to claim 1, further comprising:

a sheet conveying device configured to convey a sheet while nipping the sheet between the pressing body and the pressing target body in the pressing state of the pressing device.

7. The image forming apparatus according to claim 6, wherein the sheet conveying device is a fixing device configured to fix an image on the sheet nipped between the pressing body and the pressing target body.

* * * * *